United States Patent [19]

Feldman et al.

[11] Patent Number: 4,767,521

[45] Date of Patent: Aug. 30, 1988

[54] TREATMENT OF FEED FOR HIGH SEVERITY VISBREAKING

[75] Inventors: Robert J. Feldman, Passaic; James M. Chen, Edison; Andrei Rhoe, Wyckoff; Roger P. Van Driesen, Titusville; C. Bertil Fogman, Kinnelon; Donald P. Satchell, Summit, all of N.J.

[73] Assignee: Lummus Crest, Inc., Bloomfield, N.J.

[21] Appl. No.: 943,175

[22] Filed: Dec. 18, 1986

[51] Int. Cl.[4] ..... C10G 55/04

[52] U.S. Cl. ..... 208/85; 208/86; 208/87; 208/88; 208/106; 208/177

[58] Field of Search ..... 208/85, 86, 87, 106, 208/88, 177

[56] References Cited

U.S. PATENT DOCUMENTS

| | | | |
|---|---|---|---|
| 2,133,240 | 10/1938 | Atwell | 208/86 |
| 2,191,972 | 2/1940 | Ocon | 208/86 |
| 4,379,747 | 4/1983 | Yan | 208/251 R |
| 4,389,302 | 6/1983 | Garwin et al. | 208/87 |
| 4,428,824 | 1/1984 | Choi et al. | 208/86 |
| 4,454,023 | 6/1984 | Lutz | 208/96 |
| 4,514,283 | 4/1985 | Closmann et al. | 208/86 |
| 4,544,479 | 10/1985 | Yan | 208/106 |

*Primary Examiner*—Anthony McFarlane

*Attorney, Agent, or Firm*—Elliot M. Olstein; John N. Bain; John G. Gilfillan

[57] ABSTRACT

Prior to upgrading a viscous feed by visbreaking, at least a portion of the feed is treated to remove a heavy phase in specified amounts, whereby the severity of the visbreaking may be increased. The Shell Hot Filtration number of the visbreaking product is reduced by at least 75%, compared to visbreaking of untreated feed at some severity.

19 Claims, 1 Drawing Sheet

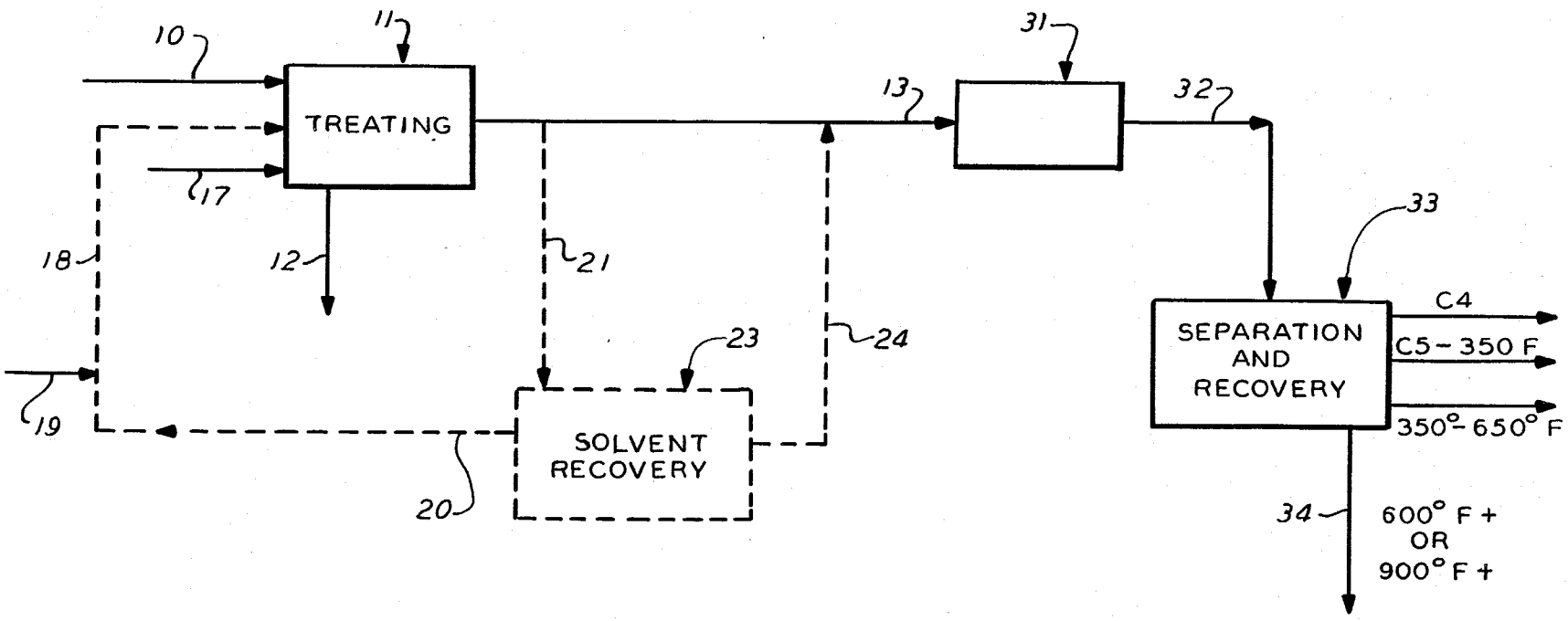
TREATING
SOLVENT RECOVERY
SEPARATION AND RECOVERY
C4
C5 – 350 F
350° – 650° F
600° F + OR 900° F +
10
11
12
13
17
18
19
20
21
23
24
31
32
33
34

TREATMENT OF FEED FOR HIGH SEVERITY VISBREAKING

This invention relates to upgrading of feeds by visbreaking, and more particularly, to a process for increasing the severity of a visbreaking operation.

Feeds from a wide variety of sources have been subjected to visbreaking (both thermal visbreaking and hydrovisbreakng) to upgrade the feed by converting higher boiling materials to lower boiling materials. In general, such feed contains at least 25 volume percent of materials boiling above about 850° F., which are derived from a wide variety of sources, and the visbreaking operation is designed to produce lower boiling materials from such heavier materials. In attempting to upgrade feeds by a visbreaking operation, the severity of the operation has generally been limited in that attempts to operate visbreaking at higher severities results in unstable products. Moreover, depending on the severity of the visbreaking operation, coking and fouling of equipment may occur during the visbreaking reaction, which further limits the ability to increase the severity of the visbreaking operation. Thus, for a given feedstock, the greatest conversion could be achieved by increasing severity; however, such increase in severity may adversely affect product quality and/or the rate of coke formation, whereby the ability to increase conversion by increasing severity is limited.

Various schemes have been proposed for increasing the severity of a visbreaking operation. Thus, for example, U.S. Pat. No. 4,454,023 proposes to increase the severity of a visbreaking operation by subjecting heavy product from the operation to a solvent extraction step to produce, as separate fractions, solvent extracted oil, resin and asphaltene, with the resin fraction being recycled to a visbreaking operation to permit an increase in severity. Such an operation uses a conventional deasphalting solvent to produce a product fraction, which is essentially free of asphaltenes. In this operation, in general, about 40% or more of the feed to the deasphalting is recovered as asphaltenes.

In accordance with the present invention, there is provided a procedure for upgrading heavy viscous materials by a visbreaking operation by treating feed to the visbreaking to separate components which adversely affect product stability, without removing all of the asphaltenes. Applicant has found that a visbreaking operation can be improved by removing certain materials from the feed to the visbreaking, without the necessity of removing all of the asphaltenes, whereby the severity of the visbreaking operation may be increased.

In accordance with one aspect of the present invention, at least a portion of a visbreaking feed is treated, prior to visbreaking, to separate a heavier fraction thereorm, with the separated heavier fraction being removed in an amount no greater than 15%, by weight, of the 650° F.+ portion of the visbreaking feed, on a diluent free basis, with the remaining feed, when subjected to visbreaking producing a visbreaking product having a Shell Hot Filtration number which is at least 25% less than the Shell Hot Filtration number of the visbreaking product which would be produced under the same conditions without feed treatent. Thus, the feed is treated to separate a heavier portion thereof, without removing all of the asphaltenes, with the heavier portion being removed to provide a remaining feed which when subjected to visreaking produces a product having a reduced Shell Hot Filtration number.

Treatment of the feed as hereinabove described allows the visbreaker to be operated at a higher severity without excessive coking or fouling (without coking or fouling which would result in an uneconomical operation). In this manner, overall yield can be increased. Thus, in accordance with this aspect of the present invention, the viscous feed is subjected to visbreaking at a severity which, in the absence of feed treatment, produces a Shell Hot Filtration number having a value Y which is in excess of 0.25 and which is preferably in excess of 0.3, and the feed is pretreated prior to visbreaking to remove heavier components in an amount of less than 15 weight percent and provided a reamining feed which, when subjected to visbreaking at such severity, produces a visbreaking product having a Shell Hot Filtration number which is no greater than 0.75 Y.

More particularly, in accordance with one aspect of the present invention, a heavy viscous material is upgraded by a visbreaking operation (either thrmal or hydro-visbreaking) at a severity such that the visbreaking product, in the absence of treatment of feed, would have a Shell Hot Filtration number of at least about 1.33 times greater than the Shell Hot Filtration number of the visbreaking product produced from the treated feed, with all or a portion of the feed having been treated to separate a heavier fraction therefrom with the heavier fraction separated from the feed being no greater than 15%, by weight of the 650° F.+ feed, on a diluent free basis, and preferably not greater than 10%, (most preferably not greater than 5%), all by weight, of the 650° F.+ feed to the visbreaking, on a diluent free basis. The Shell Hot Filtration number is based on the 650° F.+ fraction. The manner of obtaining the Shell Hot Filtration number is reported in hereinafter example.

The Shell Hot Filtration number is a weight percent.

More particularly, applicant has found that is it possible to increse the severity of a visbreaking operation by treating all or portion of the feed to separate certain materials from the feed or portion thereof, without removing all of the asphaltenes, which results in an increase in overall yeild. Thus, the severity of the visbreaking operation is increased so that the visbreaking produce at such severity, in the absence of the feed treatment, would have a Shell Hot Filtration number which is at least about 1.33 times grater than the Shell Hot Filtration number of the product produced from the treated feed, with the heavier components which are removed from the feed being no greater than 15 weight percent of the diluent free feed to the visbreaking; whereby unstable components are separated from the visbreaking feed, without the necessity of removing all of the asphaltenes.

The manner in which visbreaking feed is treated to provide a visbreaking product having a reduced Shell Hot Filtration number, as hereinabove described, is dependent upon the feed material to the visbreaking. Thus, the treatment is directed toward removing materials which produce in the visbreaking product, a separate phase, which separate phase is heavier (higher specific gravity) than the main product phase.

In some cases, it may be possible to visbreak at a high severity to provide visbreaking product having a reduced Shell Hot Filtration number, as hereinabove described, by physically separating a heavier separate phase from the feed by techniques such as centrifugation, filtration, gravity settling, etc., with centrifuging being particularly preferred.

In other cases, in order to provide a reduced Sheel Hot Filtration number, as hereinabove described, it may be necessary to enhance the separation of a separate heavier phase from the feed by use of a promoter liquid or anti-solvent so as to reduce the solubility of the components which form materails in the product which adversely affect product stability, followed by physical separation of such components from the feed or feed portion and visbreaking at a high severity to provide a visbreaking product having a reduced Shell Hot Filtration number, as hereinabove described.

In still another case, it may be necessary to add a diluent liquid, which does not significant increase or decrease the solubility of the components which produce materials which form a separate phase in the reaction product, with the diluent liquid functioning to reduce the viscosity of the feed to a value which permits physical separation of unstable components at the required operating conditions.

In accordance with a particularly preferred embodiment, The Shell Hot Filtration number of the visbreaking product is reduced, as hereinabove described, by centrifugation of all or a portion of the feed, with or without the addition of a liquid, which functions as a diluent and/or anti-solvent to remove a heavier phase prior to visbreaking.

The visbreaking feed or portion thereof is generally treated at a temperature of from 200° F. to 700° F., and preferably from 300° F. to 700° F. for the purpose of removing a heavier phase therefrom. In addition, the viscosity of the feed or portion thereof which is to be treated must be at a value which permits separation of a heavier phase from the feed or feed poriton in the separation equipment. The viscosity of the feed during treatment is determined, in part, by the method which is used for physically separating the two phases. In general, the viscosity in the treating equipment is in the order of from 50 centistokes to 0.1 centistokes, at the treating temperature. The treating pressure may be in the order of from atmospheric pressure to 200 psig.

As should be apparent, in the case where a centrifuge is used, as in the preferred embodiment, the viscosity of the feed introduce into the centrifuge must be at a value such as to permit proper operation of the centrifuge at the treatment temperature. As should be apparent, viscosity increases with a decrease in the treatment temperature, whereby, depending upon the temperature of operation, it may not be necessary to add a dilutng liquid to reduce viscosity at the treatment temperature. In soem cases, the liquid which is added may, in addition to reducing viscosity, function as an anti-solvent, as hereinabove described.

As hereinabove described, in order to reduce the Shell Hot Filtration number of the product produced in visbreaking at a high severity, which, in the absence of treatment produces higher Shell Hot Filtration numbers, it may be necessary to use an anti-solvent to provide controlled rejection of additional components from the feed. In particular, the anti-solvent provides for reducing the solubility of components in the feed which proiduce materials in the visbreaking which adversely affect product stability. The anti-solvent employed as well as the amount thereof is such that no more than 15%, by weight, of the diluent or solvent free feed to the visbreaking is removed from the feed as heavier components.

Liquids used as anti-solvents, in the case of the use of a hydrocarbon liquid, have a Watson characterization factor which characterizes such liquids as being more aliphatic than aromatic, with the Watson characterization factor generally being from 9–12. The liquid may be comprises of one or more components; e.g., the promoter liquid may be a cycle oil or a gas oil (350°–650° F.). It is to be understood, however, that liquids other than hydrocarbons may be employed for anti-solvent properties, provided that such liquids provide a controlled insolubilization of material as hereinabove described.

Thus, as should be apparent, the visbreaking feed or feed portion is treated in a manner so as to reduce the Shell Hot Filtration number of the high severity visbreaking produce as hereinabove described, with the visbreaking being operated at a severity, which in the absence of feed treatment, would produce a visbreaking product having a Shell Hot Filtration number which is at least about 1.33 times greater than the Shell Hot Fltration number produced from the treated feed. Moreover, such treatment is effected in a manner which prevents rejection of all of the asphaltenes present in the feed in that applicant has found that it is possible to increase the severity of a visbreaking operaiton, without rejecting all of the asphaltenes from the feed or product.

The feeds which are subjected to a visbreaking operation are feeds which are heavy and viscous, and which may be obtained form a wide varieyt of sources, such as petroleum sources, bitumens fromtar sands, materials derived from caol sources such as coals, lignite, peat; materials derived from oil shale; materials derived from a wide variety of petroleum sources such as residuums resulting from atmospheric and/or vacuum distillation of crude oil, heavy residues from solvent extraction processes, and the like. Such materials are generally comprised of a mixture of hydrocarbons, and are characterized by an API gravity of less than 20 degrees. Such feeds are generally known in the art, and no further details in this respect are deemed necessary for a complete understanding of the present invention.

In accordance with the present invention, a feed is subjected to visbreaking at a high severity, which severity would in the absence of feed treatment produce a product having a Shell Hot Filtration number which is at least 1.33 times greater than the Shell Hot Filtration number of the product produced from the treated feed. In general, the visbreaking (whether thermal visbreaking or hydrovisbreaking) is operated at a temperature of from 700° F. to 1000° F., and a pressure of from 25 to 2000 psig. The severity of the operation is generally sufficient to convert from 4% to 25%, by weight, of the fresh feed to 350° F.—material. Depending on the feedstock, it is to be understood that higher or lower severities may be obtained within the spirit and scope of the invention.

The equipment which is employed for visbreaking may be of a type known in the art; for example, a coil, or coil plus soaking drum, etc. As hereinabove indicated, the visbreaking may be effected thermally, or may be a hydrovisbreaking operation, in which case, gaseous hydrogen or a donor liquid is added to the feed material.

Thus, in accordance with an aspect of the present invention, the treatment of the feed and the severity of the visbreaking are coordinated in a manner such that, in the absence of the feed treatment, the severity would produce a producing having a higher Shell Hot Filtration number, and as a result of the feed treatment, visbreaking at such sevrity produces a product having a lower shell Hot Filtration number, with no more than 15 weight percent of the 650° F.+ material of the feed having been separated from the feed as a heavier phase during such treatment. In this manner, the visbreaking may be operated at a higher severity to increase yields without the deleterious coking and/or fouling which would occur without the feed treatment.

In accordance with a particularly preferred embodiment, the feed treatment produces a visbreaking product having a Shell Hot Filtration number of less than 0.25 and preferably less than 0.15, with the visbreaking being operated at a severity, whereby the visbreaking product, in the absence of the feed treatment, would have a Shell Hot filtration number of greater than 0.25 (preferably at least 0.3).

In accordance with an embodiment of the present invention, all or a portion of the feed which is to be subjected to pretreatment in accordance with the present invention is preconditioned to promote controlled rejection of components into the heavy phase during the pretreatment.

More particularly, in some cases, in order to provide for a reduction in the Shell Hot Filtration number, without separating a heavy phase in an amount in excess of 15%, by weight, based on the 650° F.+ fraction of the feed, all or a portion of the feed to be subjected to the pretreatment is conditioned by heat treatment at a temperature and for a time which provides for controlled rejection during the pretreatment of components which adversely affect product stability, without removing all of the asphaltenes during the pretreatment. In general, such heat treating is effected at a temperature of at least 550° F., preferably at least 650° F., with the temperature generally not exceeding 850° F., and preferably not exceeding 750° F. The heat treating is generally effected at a residence time of at least 0.1 minute, preferably at least 1 minute. In most cases, the residence time does not exceed 10 minutes, and most generally does not exceed 5 minutes. The thermal conditioning may be accomplished at pressure of from atmospheric pressure up to 400 psig.

BRIEF DESCRIPTION OF THE DRAWING

The invention will be further described with respect to the following drawing, wherein:

The drawing is a simplified schematic flow diagram of an embodiment of the present invention.

A visbreaking feed in line 10 is introduced into a tretng zone, schematically generally indicated as 11 to separate heavier components therefrom and to reduce the Shell Hot Filtration numer of the product produced in a subsequent visbreaking operation as hereinabove described, without removing more than 15% percent, by weight, of the materials introduced into the treating zone 11 through line 10.

Depending upon the characteristics of the material in line 10, as well as the specific conditions for visbreaking, it may or may not be necessary to add additional components to the treating zone 11 to enable removal of heavier components, as hereinabove described, and thereby reduce the Shell Hot Filtration number of the product produced in the visbreaking, with removing all of the asphaltenes from the feed. Similarly, all or a portion of the visbreaking feed may or may not have been subjected to thermal precondition, as hereinabove described, prior to treatment in zone 11.

Thus, for example, in one embodiment the feed in line 10 is treated in treating zone 11 to recover heavier components through line 12 and provide a remaining feed in line 13, without adding an extraneous material to the treating zone 11.

In another embodiment, a diluent may be added to the treating zone 12 through line 17, to reduce viscosity to a value effective for the treatment in treating zone 11.

As a further embodiment, it may be necessary to employ an antisolvent in order to reduce the Shell Hot Filtration number of the visbreaking produce, as hereinabove described, without removing more than 15 weight percent of the undiluted feed to the treating zone, as heavier components through line 12. In such an mbodiment, anti-solvent in line 18, which is comprised of fresh feed antisolvent in line 19 and recycle antisolvent in line 20 is introduced into the treating zone 11 for reducing the solubility of a portion of the components introduced through line 10 to reduce the Shell Hot Filtration number of the visbreaking product, without removing more than 15 weight percent of the feed introduced through line 10. In such an embodiment, a mixture of the remaining product and antisolvent is recovered from treating zone 11, and the mixture is introduced through line 21 into a solvent recovery zone, schematically generally indicated as 23. In the solvent recovery zone 23, solvent is recovered through line 20 for recycle, and remaining product is recovered through line 24, which may be used as net feed to the visbreaker in line 13.

The treating zone 11 is preferably comprised of one or more centrifuges for effecting separation of the heavy components; however, as hereinabove described, other separating devices may be employed.

The treated or remaining feed in line 13 is introduced into a visbreaking unit, schematically generally indicated as 31.

The visbreaking unit 31 may be of a type known in the art and may be compreises of a coil, or preferably a coil plus soaking drum. The visbreaker is operated to provide a high severity operation wherein the product recovered from the visbreaker 31, in line 32, in the absence of feed treatment, would have a Shell Hot Filtration number in excess of 0.25, and preferably in excess of 0.3; however, as a result of the feed treatment, at such severity, the visbreaking product has the hereinabove described lower values.

The product in line 32 is introduced into a separation zone, schematicllly shown as 33, which may contain one or more columns and/or other types of separation devices. In the separation zone 33, the visbreaking product is separate to recover, preferably as separate fractions, a C4-gas, a C5 to 350° F. gasoline fraction, and a 350° to 650° F. gas oil fraction. Depending upon the products desired, the separation zone 15 may be operated to recover a 650° F.+ fraction, or alternatively, the separation zone 33 may be operated to recover a heavier gas oil fraction which boils from 650° to 900° F., and a heavier fraction, in lines 34 which is a 900° F. plus fraction, which 650° F.+ or 950° F.+ fraction in line 34 may be combined with a cutter stock for use as a fuel oil.

Thus, as should be apparent, in accordance with the preferred embodiment, feed to the visbreaking is treated with or without a diluent or with or without an antisolvent to reduce the Shell Hot Filtration number of the visbreaking product as hereinabove described, without removng all of the asphaltenes from the feed, in particular, in the treating to reduce the Shell Hot Filtration number of the product, no more than 15 weight percent, preferably no more than 10 weight percent, and most prefeably no more than 5 weight percent of the diluent free heavy material of the feed subjected to treatment is separated from the feed, as a heavier phase.

Although the invention has been described with respect to specific embodiments shown in the drawing, it is to be understood that the scope of the invention is not to be limited thereby. Thus, for example, although in the preferred embodiment, the entire feed is treated, it is possible to treat a portion of the feed.

It is also to be understod that various portions of the overall system have not been described in detail; however, such portions are deemed to be within the scope of those skilled in the art from the teachings herein. Thus, for example, the visbreaking effluent, prior to separation, may be cooled by a direct quench operation by using heavier material from the separation zone.

Although in accordance with a preferred embodiment, the visbreaking product is employed for making a fuel oil, it is to be understood that other uses are also within the spirit and scope of the present invention.

The present invention will be further described with respect to the following examples; however, the scope of the invention is not to be limited thereby:

EXAMPLE 1

Shell Hot Filtration Test

This test is reported in J. Inst. Petroleum vol 37. No. 334 P. 596–604, and the apparatus for performing the test is shown therein.

Apparatus

1. Pressure filter
2. ⅛" Hard felt disc.
3. Whatman No. 50 filter paper, 7 cm. ia.
4. 2–1000 ml. Erlenmeyr filtering flasks.
5. n-Heptane, Industrial Grade.
6. 1000 mm Open and Mercury Manometer.
7. Pour point test jar. or 4 oz. oil sample bottle.
8. 20 ml. graduate.
9. 250 ml. graduate.
10. Oil bath.
11. 10 ml. pipette.
12. 25 ml. graduate.

Procedure

1. Place 50 gms of sample in pour test jar and suspend in oil bath held at 212° F. for 24 hours. (This step to be disregarded when testing material on an "as-received" basis.)

2. Dry filter paper in oven at 220° F. for ½ hour. Store papers in a dessicator, no dissicant, for 1 hour. Weigh to 4th place.

3. Remove steam jacket from filter and place felt disc on perforated plate. Flat part of plate goes down. Place weighed filter paper on felt and connect vaccuum. Apply enough vacuum, approx. 30 mm Hg., to hold down paper. Attach steam jacket, inlet on top.

4. Shut off vacuum and pass steam through jacket, make sure jacket is hot. Weigh an empty 30 ml. beaker and add approximately 10.3 gms of sample. This will be the gross weight. The additional 0.3 gms of sample is for stickage in beaker after pouring sample onto filter pad.

5. Pour 10.0±0.1 gms of sample (held at approximately 210° F.) on filter paper, ensuring that no sample runs off filter shell wall.

6. Attach filter top tighten top 4 nuts and slowly apply nitrogen to filter shell, increasing pressure in 2 lb. increments to 15-20-30-40 psig until filtration starts. Amount of pressure required is dependent on density of sample. Complete filtration should take 5–10 minutes for sample to pass through.

7. Now re-weigh beaker plus stickage to get tare weight. Subtract this weight from the previous gross weight to get net weight of sample used for the filtration test.

8. When filtration is complete, indicated by passage of nitrogen through filter and vacuum control bleed line, decrease or increase amount of $N_2$ to 20 psig for additional 5 minutes until there is negligble drippage of sample through filter paper and felt pad. Turn off $N_2$ and vacuum and remove filter top.

9. If cake or paper is dry, shut off and detach steam inlet and hook-up to cooling water for 10 minutes. Water inlet can be at top or bottom.

10. Then filter is cool, wash wall and cake with 2–10 ml washings of n-heptane using 10 ml pipette and then with 9–20 ml washings using 25 ml graduate (apply enough vacuum to maintain a steady drip) approx. 80–100 mm Hg. or until filtrate is clear. To suction off remaining n-heptane retianed in felt pad after each 20 ml wash, it is advisable to apply approximately 300 mg.Hg. vacuum or blocking off va. bleed line with the thumb for 10 seconds. Lighter gravity material will require 200 ml minimum of wash and 300 ml maximum for heavier gravity material. After final 20 ml wash, apply maximum vacuum for 1 minute.

11. Remove vacuum and steam jacket. Any oil present on paper where jacket rim rested on paper should be washed away with n-heptane. Leave paper on pad with maximum vacuum and wahs outer edge of paper with 10 ml n-heptane using eye-dropper. Be careful to wash edge of paper so that n-heptane will flow toward recessed groove of filter paper.

12. Remove paper and dry in oven at 220° F. for ½ hour and cool in dessicator (no dessicant) for 1 hour.

Calculation and Report 13. a. Calculate the Shell Hot filtration Number of the sample as follows:

$$\text{Shell Hot filtration Number} = A100/W$$

A = weight of dry sludge, grams
W = weight of sample, grams.

Precision

14. Repeatability

Duplicate results by the same operator should not be considered suspect unless they differ by more than 0.03 weight percent absolute.

EXAMPLE 2

Please provide details of P Test.

The present invention is particulary advantageous in that the visbreaker may be oprated at highe rseverities, without the disadvantages heretofore encountered in the art; for example, an unstable heavier product and/or severe fouling and cking of equipment. By operating at a higher severity, the yield of lighter products is increased.

Moreover, in treating the visbreaking feed in accordance witht eh present invention, as compared to prior art deasphalting techniques, the desired increase in severity is obtained, without removal of all of the asphaltenes which are potentially convertible to usable product.

These and other advantages should be apparent to those skilled in the art of the teachings herein.

In the present specification, and in the claims, in describng the characteristics of the visbreakng product in the absence of feed treatment, as well as the characteristics of the visbreaking product resulitn fromt he treated feed, with respect to the Shell Hot filtration Number, it is to be understood that actual measurement of the Shell Hot Filtration Number, as part of the processing paramemters, is not necessary to bring a process within the scope of the appended claims in that the Shell Hot Filtration Number defines a characteristic of the feed or product.

Numerous modifications and variations of the present invention are possible in light of the above teachings and, therefore, within the scope of the appended claims, the invention may be practiced otherwise than as particularly described.

What is claimed is:

1. A process for upgrading a viscous feed, comprising:

prior to visbreaking, treating at least a portion of a viscous visbreaking feed including a 650° F.+ fraction to separate a heavy phase containing an asphaltene portion thereform and provide a treated viscous feed; and subjecting treated viscous feed to visbreaking at a severity which in the absence of said treating produces a visbreaking product having a Shell Hot filtration Number of Y and which is greater than 0.25, during said treating separating the heavy phase in an amount no greater than 15%, by weight, based on the 650° F.+ fraction of the viscous visbreaking feed and which produces a visbreaking product from the visbreaking of the treated viscous feed which has a Shell Hot Filtration Number of no greater than 0.75 Y.

2. The process of claim 1 wherein said treating comprises centrifugation to separate a heavier phase from the feed.

3. The process of claim 1 wherein said treating includes the addition of an antisolvent to said at least a portion of the viscous feed.

4. The process of claim 1 wherein said treating includes the addition of a diluent to said at least a portion of the viscous feed.

5. The process of claim 1 wherein the visbreaking product produced from the remaning viscous feed has a Shell Hot Filtration number of less than 0.25.

6. The process of claim 2 wherein the heavy phase is separated in an amount no greater than 5% by weight, of the 650° F.+ fraction of the feed.

7. The process of claim 6 wherein the treating includes the addition of an anti-solvent to said at least a portion of the viscous feed.

8. The process of claim 6 wherein the treating includes the addition of a diluent to said at least a portion of the viscous feed.

9. The process of claim 1 wherein at least a portion of the feed subjected to the treating is preconditioned by heat treatment at a tempreature of at least 550° F. and no greater than 750° F.

10. The process of claim 1 wherein the treating is effected at a temperatue of from 200° F. to 700° F.

11. the process of claim 1 wherein the visbreaking is effected at a severity to convert from 4% to 25%, by weight, of the viscous feed to 350° F.− material.

12. The process of claim 10 wherein the visbreaking is effected at a severity to convert from 4% to 25%, by weight, of the viscous feed to 350° F.− material.

13. The process of claim 12 wherein the heavy phase is separated in an amount no greater than 5% by weight, of the 650° F.+ fraction of the feed.

14. The process of claim 9 wherein the treating is effected at a temperature of from 200° F. to 700° F.

15. The process of claim 14 wherein the visbreaking is effected at a severity to convert from 4% to 25%, by weight, of the viscous feed to 350° F.− material.

16. The process of claim 15 wherein the visbreaking product produced from the treated viscous feed has a Shell Hot Filtration number of less than 0.25.

17. The process of claim 2 wherein the visbreaking product produced from the treated viscous feed has a Shell Hot Filtration numbr of less than 0.25.

18. The process of claim 17 wherein the treating is effected at a temperture of from 200° F. to 700° F.

19. The process of claim 1 wherein said visbreaking product is suitable for blending with a cutter stock for use as a fuel oil.

* * * * *